United States Patent [19]

Seely

[11] Patent Number: 5,000,290

[45] Date of Patent: Mar. 19, 1991

[54] SCAFFOLD FLOORING ATTACHMENT CLAMP

[76] Inventor: Phillip D. Seely, 231 Windsor Oaks, Mineral Wells, W. Va. 26150

[21] Appl. No.: 486,753

[22] Filed: Mar. 1, 1990

[51] Int. Cl.[5] ..... E04G 5/08; E04G 8/28

[52] U.S. Cl. ..... 182/222; 182/119; 248/230; 248/247; 248/235

[58] Field of Search ..... 182/222, 223, 119; 248/235, 230, 247

[56] References Cited

U.S. PATENT DOCUMENTS

| | | | |
|---|---|---|---|
| 250,111 | 11/1881 | Tallmadge | 248/230 |
| 565,293 | 8/1896 | Morgan . | |
| 745,094 | 11/1903 | Cummons . | |
| 1,449,700 | 3/1923 | Sampson . | |
| 1,890,029 | 12/1932 | Delfs | 182/222 |
| 2,245,977 | 6/1941 | Houk | 248/230 |
| 2,928,443 | 3/1960 | Sevachko | 182/222 |
| 3,047,263 | 7/1962 | Mittenzwei . | |
| 3,664,621 | 5/1972 | Savoie, Jr. . | |
| 3,854,552 | 12/1974 | Kensrue . | |
| 4,049,230 | 9/1977 | Minniear . | |
| 4,340,130 | 7/1982 | Payne | 182/119 |

FOREIGN PATENT DOCUMENTS

| | | | |
|---|---|---|---|
| 756961 | 4/1967 | Canada | 182/222 |
| 298886 | 1/1989 | European Pat. Off. | 182/222 |
| 1185419 | 7/1959 | France | 182/222 |
| 1350295 | 11/1987 | U.S.S.R. | 182/222 |

*Primary Examiner*—Reinaldo P. Machado
*Attorney, Agent, or Firm*—Cushman, Darby & Cushman

[57] ABSTRACT

A scaffold flooring attachment clamp utilizing two identical rotably connected members to attach a cross-member of a scaffold suporting structure to a scaffold flooring. Each of the identical members includes a semi-circular jaw portion and a tab portion, with the semi-circular jaw portions being arranged so as to oppose each other, and are therefore adapted to receive and hold the cross-member of the scaffold supporting structure. The tab portion of the clamp is adapted to being bent over and affixed to the scaffold flooring such that the attachment clamp is locked in place securing the scaffold flooring to the scaffold supporting structure.

6 Claims, 4 Drawing Sheets

SCAFFOLD FLOORING ATTACHMENT CLAMP

FIELD OF THE INVENTION

The present invention relates to a device for attaching scaffold flooring to a scaffold supporting structure. More particularly, this device is related to an attachment clamp which can be utilized to attach the scaffold flooring to the scaffold supporting assembly after the scaffold flooring has been laid.

BACKGROUND OF THE INVENTION

Devices incorporating the principles of the present invention may be used in many environments, but the most widespread use of such clamps would be in the construction of scaffolding structures. In applying a scaffold flooring to the scaffold supporting structure, the general practice has been to simply place planking on the scaffold cross-members at the required level. During use, however, the planks can creep and shift as a result of work or activity and in some cases may move to such an extent that a hazard to worker safety is created. In an extreme case, these loosely placed planks may even fall or be kicked from the scaffold supporting structure. Efforts have been made to solve this problem by toe-nailing adjacent planks together, but this solution has not proven to be entirely successful.

There is therefore an urgent need for an effective clamping device by which the scaffold flooring can be easily and effectively secured to the cross members of the scaffold supporting structure and yet which may be quickly and easily detached for disassembly and reuse.

One known method of attaching planks is disclosed in Kensrue U.S. Pat. No. 3,854,552. The Kensrue device is a rather elaborate combination of clamping bars, engaging hooks and hand operated nut and screw members. The clamp disclosed by Kensrue solves the problem of loose planking by providing separate clamping devices for the ends of each plank. This clamping is achieved by placing a clamping bar on the underside of each plank such that this clamping bar engages the scaffold cross-member and the under surface of the planking. A hand-turned nut means is provided such that plank engaging hook members are forced to clampingly coact with the clamping bar and securely anchor the plank to the cross member. Utilizing the device as disclosed in Kensrue would require the worker to apply each clamp from the plank underside one plank at a time.

The problem with the known plank securing method is that the clamps must be placed and fastened as the scaffold flooring is being placed. This leaves the worker assembling the scaffolding with no platform on which to work while attaching the planks to the structure. The present invention solves this problem by providing a plank securing clamp that can be placed and attached after the scaffold supporting structure has been built and all the scaffold flooring planks have been laid in place. The present invention achieves this solution by providing a separate clamping device for insertion between every two adjoining planks each clamp including both a portion being adapted to receive and hold a scaffold support cross member, and a portion being adapted to be bent over each of the adjoining scaffolding planks and affixed thereto.

SUMMARY OF THE INVENTION

The present invention is concerned primarily with scaffold structures and is more particularly concerned with providing a unique means for anchoring or securing scaffold flooring to the scaffold supporting structure.

One object of the herein described invention is to provide a unique means for simply and inexpensively securing scaffold planking against lifting, creeping or shifting.

A further object is to provide a novel clamping device for securing the ends of the scaffold planking to a cross member of the scaffold supporting structure.

Another object of the present invention is to provide a plank securing clamp that can be placed and attached after the scaffolding has been built and the scaffold flooring has been placed.

Another object is to provide a novel clamping device for scaffold planking which can be inserted between two adjoining planks, rotated into engagement with a scaffold supporting member and affixed to the adjoining two planks such that these planks are securely held in place against the scaffold supporting structure.

Further objects and advantages of the invention will be brought in the following part of the specification, wherein a detailed description is for the purpose of fully disclosing a preferred embodiment of the invention without placing limitations thereon.

BRIEF DESCRIPTION OF THE DRAWINGS

Referring to the accompanying drawings, which are for illustrative purposes only.

A DESCRIPTION OF A PREFERRED EMBODIMENT

Figure 1:
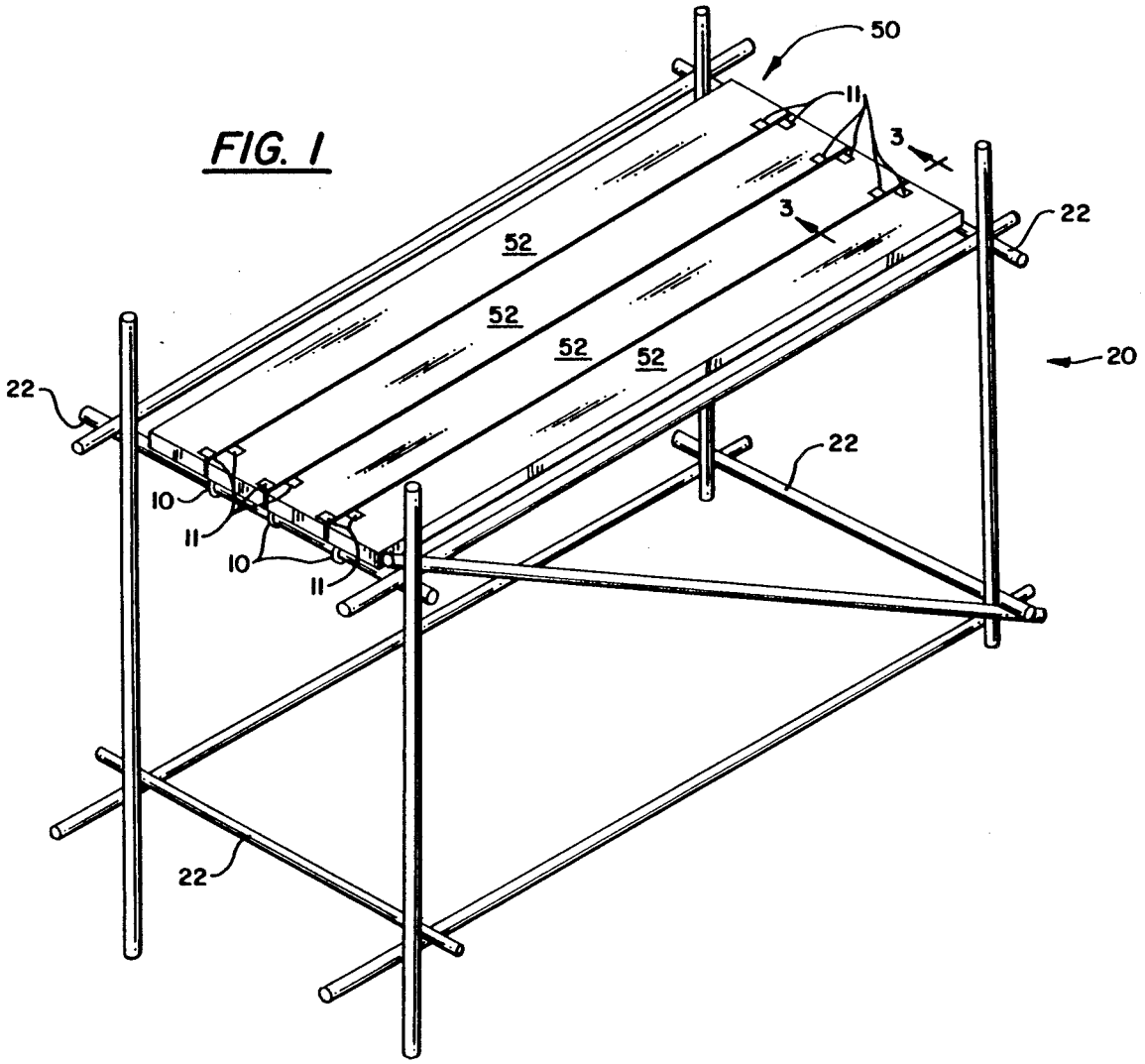
FIG. 1 is a fragmentary perspective view of a scaffold structure in which the planking is secured by clamping devices embodying the features of the present invention.

For illustrative purposes, it may be helpful to refer to the drawings. The invention is shown being applied to the scaffold flooring 50 of a scaffold supporting structure 20 constructed of piping and including cross-members 22 which form the support for the plurality of planks 52 which form the scaffold flooring 50. The planks 52 are substantially identical in construction and lie in a parallel, horizontal, side-by-side arrangement and extend across the supporting cross-members 22 to form a floor for workmen to walk on.

To minimize the dangers associated with shifting and creeping at the planks 52, clamping devices 10 according to the present invention are provided between every two of the adjoining planks 52 to securely attach these planks to the cross-members 22. The clamping devices of the present invention are positioned along the planks 52 at a position correlating to the point where the planks cross the cross-members 22 of the supporting structure 20.

Figure 2:
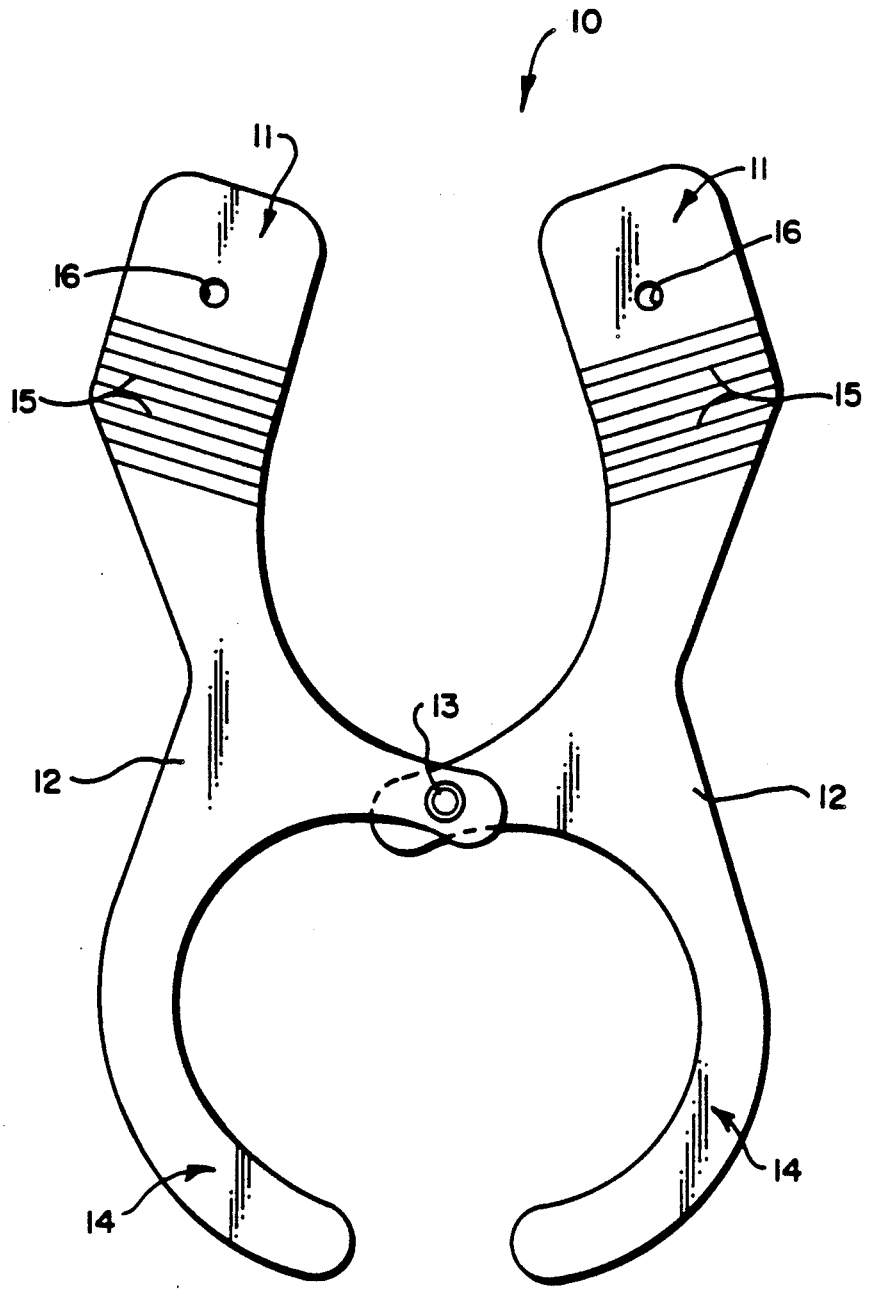
FIG. 2 is a top plan view of the scaffold flooring attachment clamp of the present invention.

FIG. 2 best illustrates the clamping device 10 of the present invention. Each clamping device 10 comprises two identical substantially planer members 12. Each of the identical members 12, include at opposite ends, substantially semi-circular jaw portions 14 and tab portions 11, with a pivot point 13 being provided between the two ends. Each of the identical members 12 further include corrugated portions 15 located adjacent the tab portions 11. These corrugated portions facilitate the bending of tab portions 11 so as to cause these tab portions to extend in a plane that is substantially perpendicular to the plane of the unbent portions of members 12. Each member 12 also includes an aperture 16 permitting the passage of any known mechanical affixing device such as a nail 60. Each aperture 16 is located at the center of the tab portions 11.

Figure 3:
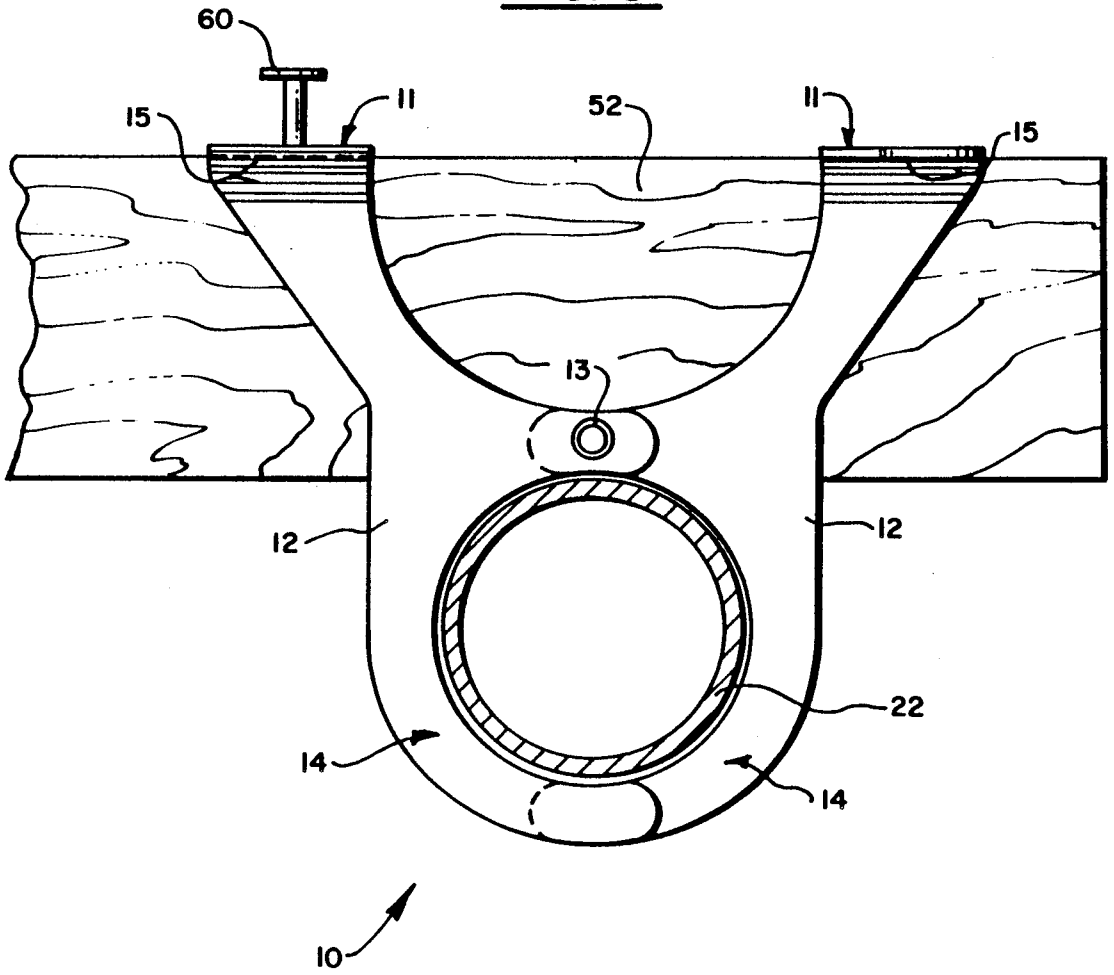
FIG. 3 is a fragmentary sectional view taken substantially along line 3—3 of FIG. 1.
Figure 4:
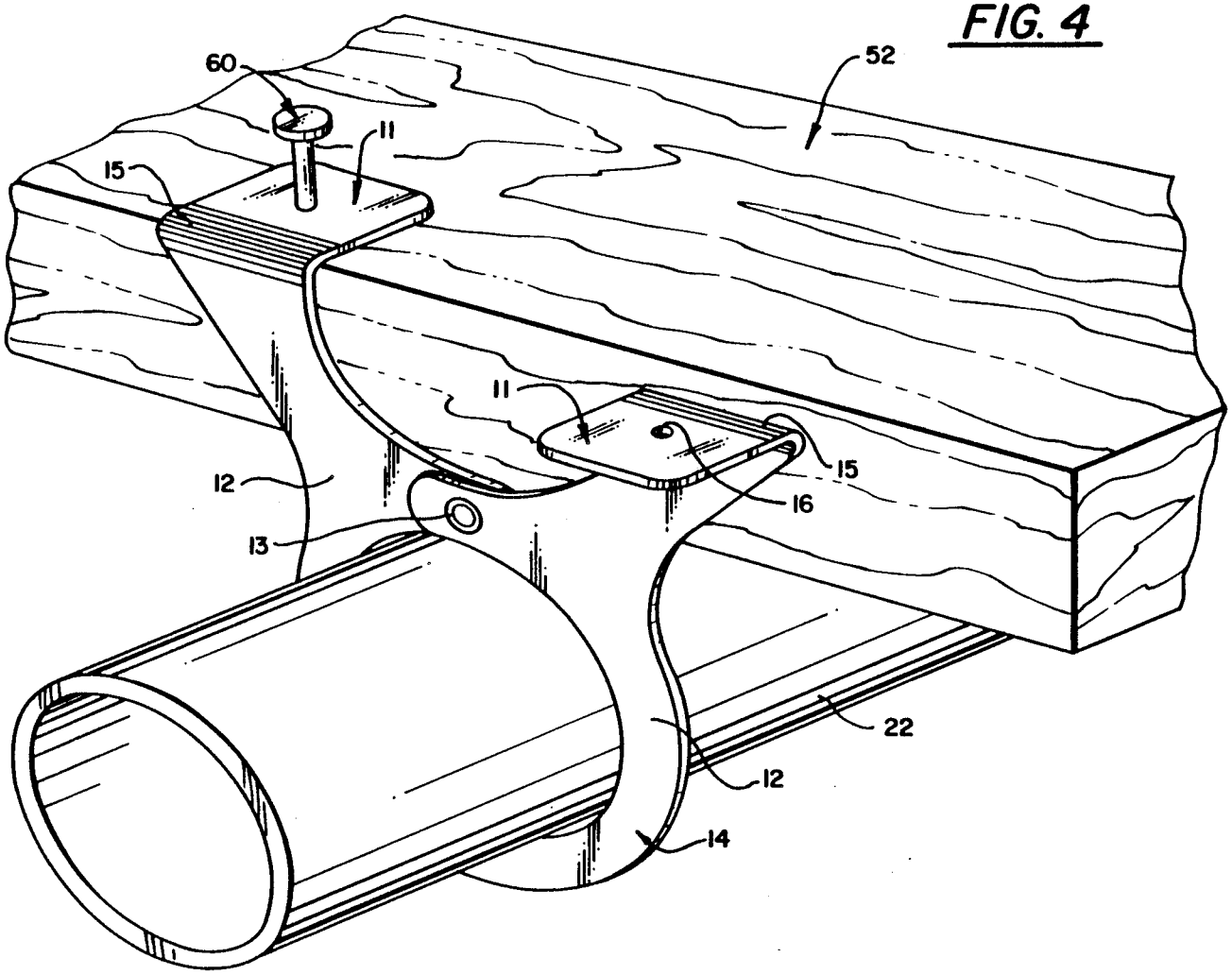
FIG. 4 is an enlarged fragmentary isometric view, taken substantially along line 3—3 of FIG. 1.

The substantially identical plane members 12 are rotably connected by any known means at the rotation point 13 such that the semi-circular jaw portions are in a confronting, opposed relation with one another. So arranging the two members 12 of the clamping device 10 permits the two members to rotate relative to each other so as to not only be capable of receiving the cross-member 22 but also of being capable of holding that cross-member within the semi-circular jaw portions 14 as is illustrated in FIGS. 3 and 4.

In operation, the worker assembles the scaffold supporting structure 20 and then lays the planks 52 side by side across the cross-members 22 of that scaffold supporting structure. The clamping devices of the present invention are then inserted between every two adjoining planks 52 at the point where these planks cross the cross-member 22. The clamping device 10 is then manually operated to cause rotation about the rotation point 13 such that the semi-circular jaw portions 14 extend apart and are capable of receiving the cross-member 22. Following insertion of the cross-member 22 between the semi-circular jaw portions 14, the device 10 is manually operated so as to cause rotation about rotation point 13, causing the jaw portions 14 to encircle and hold the cross-member 22. The tab portions 11 of each of the two identical members 12 are then manually bent over the planks 52 most adjacent these members and affixed to these planks so as to lock the clamping device 10 in position.

As for the first and last planks in a series, of course there is no neighboring plank at their outer edge. In such cases, one tab can be bent and fastened to that plank and the other left unfastened, or bent the same direction and fastened to the same plank.

In use, the devices of the invention prevent the planks from lifting-up, creeping and shifting.

FIGS. 3 and 4 most clearly illustrate the clamp of the present invention 10 in locked engagement with a plank 52 and a cross-member 22. Disassembly follows the above operation in reverse order.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the intended claims.

What is claimed is:

1. A device for attaching a scaffold flooring to a scaffold supporting structure comprising:

first and second members, each of said members having substantially semi-circular jaw portions at one end and tab portions at an opposite end, said first and second members being capable of insertion between two adjacent plank members serving as all or part of said scaffold flooring;

means for rotably connecting said first and second members together at a rotation point positioned between said jaw and said tab portions of each of said members such that said semi-circular jaw portions are in confronting opposed relation and are adapted to receive and hold a rod-shaped member of said scaffold supporting structure; and means for releasably mounting said first and said second members in engagement with said scaffold flooring such that said jaw portions of said first and second members securely hold a rod-shaped portion of said scaffold supporting structure.

2. A device according to claim 1, wherein said means for releasably mounting said first and said second members in engagement with said scaffold flooring comprises:

a means for defining a corrugated portion on each of said tab portions, said corrugated portions being adapted to permit the bending of each of said tab portions so as to overlie a top surface of said plank member most adjacent thereto; and a means for mechanically fastening said overlying tab portions to said adjacent plank members.

3. A device as in claim 1, wherein said first and second members are comprised of galvanized steel.

4. A method of operating a device with first and second members, each of said members having substantially semi-circular jaw portions at one end and tab portions at an opposite end, said device including means for rotably connecting said members together at a rotation point located between said jaws and said tab portions such that said device attaches a scaffold flooring to a scaffold supporting structure, said method comprising the steps of:

assembling said scaffold supporting structure, said structure including a pair of transversely extending rod-shaped cross-members;

laying said scaffold flooring such that said flooring overlies and crosses said pair of transversely extending rod-shaped cross-members, said scaffold flooring being comprised of at least two adjacent plank members;

inserting said device between each pair of said adjacent plank members at a position corresponding to a position where said plank members overlie and cross said cross-members;

operating said device by rotational movement such that said rod-shaped cross-member is engaged by said jaw portions;

folding said tab portions of said device such that each of said to portions overlie said plank member most adjacent thereto; and securing said tab portions to said adjacent plank members.

5. A method of attaching a cross-member of a support structure to at least two plank members comprising the steps of:

inserting an attachment device having first and second members, each of said members having substantially semi-circular jaw portions at one end and tab portions at an opposite end, said device including means for rotably connecting said members together at a rotation point located between said jaws and said tab portions such that said semi-circular jaw portions are confronting in opposed relation and are adapted to receiving and holding said cross-member;

operating said device by rotational movement such that said cross-member is engaged and held by said jaw portions;

folding said tab portions of said device such that each of said tab portions overlie said plank member most adjacent thereto; and fastening said tab portions to said plank members.

6. A scaffold, comprising a scaffold supporting structure including at least one generally horizontal rod;

at least two planks arranged side-by-side so as to have a respective two edges located in spacedly confronting relation so as to define a vertically opening gap; said planks being supported on said rod;

an attaching device, including two members hinged together by a hinge means, about a horizontal axis; each member having a jaw, said jaws being opposed to one another and gripping said rod below said planks and said hinge means;

said members having respective portions which extend upwards through said gap and terminate in a respective two generally horizontal tabs which are arranged to closely overlie respective ones of said planks; and means securing one of said tabs to one of said planks, and the other of said tabs to the other of said planks, thereby preventing ungripping of said rod by said jaws and securing said planks to said horizontal rod.

* * * * *